United States Patent [19]

Cartier et al.

[11] 4,207,008

[45] Jun. 10, 1980

[54] APPARATUS AND PROCESS FOR CONTINUOUS SURFACE TREATMENTS OF PROPELLANT POWDERS

[75] Inventors: Jean-Pierre L. Cartier, Angouleme; Louis J. J. Leneveu, Chateaulin; Jean-Marc Peyrard, Angouleme; Bernard W. Wiedemann, Pont de Buis; Didier J. Treneules, Chateaulin, all of France

[73] Assignee: Societe Nationale des Poudres et Explosifs, Paris, France

[21] Appl. No.: 902,172

[22] Filed: May 2, 1978

[30] Foreign Application Priority Data

May 11, 1977 [FR] France ..... 77 14407

[51] Int. Cl.[2] ..... B01F 7/04

[52] U.S. Cl. ..... 366/309; 366/349

[58] Field of Search ..... 366/310, 325, 309, 326, 366/312, 313, 279, 329

[56] References Cited

U.S. PATENT DOCUMENTS

| | | | |
|---|---|---|---|
| 450,591 | 4/1891 | Schrader | 366/309 |
| 572,965 | 12/1896 | Courtney et al. | 366/309 |
| 2,010,579 | 8/1935 | Broadfield | 366/329 |
| 2,877,993 | 3/1959 | Hudachek | 366/312 |

FOREIGN PATENT DOCUMENTS

| | | | |
|---|---|---|---|
| 56158 | 5/1939 | Denmark | 366/325 |

*Primary Examiner*—George F. Mautz

*Attorney, Agent, or Firm*—Bucknam and Archer

[57] ABSTRACT

The present invention relates to continuous triturators and malaxators having a horizontal drive shaft.

The apparatus preferably comprises a semi-circular chute surmounted by parallelepipedal vertical walls, and a stirrer consisting of a shaft which is concentric with the chute and carries rigid blades perpendicular to this shaft, at least one in four of the said blades being extended by a tongue which rubs against the chute, and the materials constituting the various elements which can come into contact with the grains of propellant powder being conductors of electricity.

Apparatus which makes it possible to carry out continuous surface treatments of granular propellant powders.

7 Claims, 4 Drawing Figures

APPARATUS AND PROCESS FOR CONTINUOUS SURFACE TREATMENTS OF PROPELLANT POWDERS

The present invention relates to a new apparatus which makes it possible to carry out continuous surface treatments of granular propellant powders. In the present patent, the term "propellant powders" is understood as meaning both powders having a single base, especially those based on nitrocellulose, which are obtained by the so-called "with solvent" process, and multibase powders, especially those in which one of the bases is a gelatinizing high-energy oil, such as, for example, the powders based on nitrocellulose and on nitroglycerine.

Granular propellant powders can be manufactured by various processes which are known to those skilled in the art, and especially by the so-called "spherical powders" process and by the so-called "with solvent" process. The with solvent process involves an operation in which the propellant bases are malaxated with various customary additives, and the high-energy mixture is then drawn and chopped into grains which can be in the form of flakes or cylinders. The spherical powders process involves an operation in which nitrocellulose is granulated in an aqueous medium by means of a solvent and a colloidal solution, it being possible for the small spheres based on nitrocellulose to subsequently be impregnated with a solution of nitroglycerine; the grains obtained have the shape of whole spheres, or of flattened spheres if these grains undergo a rolling operation. The grains obtained in this way are then dried and solvents which they may possibly contain are removed therefrom. The manufacture of granular propellant powders therefore generally involves one or more finishing operations which consist of surface treatments using finishing agents which are either solid, that is to say pulverulent or suspended in liquids, or liquid. These finishing agents are incorporated into the surface of the grains of powder or slightly into the interior of these grains, and they are mainly either combustion moderators or agents which make it possible to improve flammability, or flash inhibitors or protective agents. According to a particular technique, a first so-called glazing operation makes it possible to incorporate a combustion moderator in order either to increase the progressive nature, or to decrease the degressive nature, of the combustion of the grains of powder, and a second so-called graphitizing operation makes it possible to incorporate graphite as a protective agent in order to facilitate the slipping of the grains and reduce the accumulation of static electricity.

These surface treatments of grains of propellant powders, using agents, cannot be carried out in all types of apparatus. Thus, mixers having a rotary propeller are known which are satisfactory for the compounding of most industrial mixtures of solids. However, such mixers are not suitable for use in glazing or graphitizing operations, since they do not provide the correct mixing to enable the various moderators or protective agents to be incorporated into the surface of each of the grains of powder to be treated; in fact, this incorporation requires that the grains of powder should only be moved forward very slowly in the direction of the length of the vat, whilst carrying out energetic lateral mixing. Malaxators having rotary screws, such as those described, for example, in French Pat. No. 1,596,363, are also known, but these malaxators are also not suitable for use in glazing or graphitizing operations, since the said rotary screws exert a grinding action on the grains of powder to be treated, which are very sensitive to friction, and since the risks of explosion of the grains of powder are consequently too high. In general, the glazing and graphitizing operations are either carried out in drums having a horizontal axis of rotation, rotary metallic drums being described, for example, in the work "Les Poudres et Explosifs" ("Powders and Explosives") by Messrs. VENNIN, BURLOT and LECORCHE (Librairie Polytechnique Ch. Beranger, 1932, page 600), or in coating kettles having an inclined axis of rotation.

Nevertheless, the use of drums or coating kettles exhibits numerous disadvantages:

During rotation, these apparatuses must be closed, optionally by a device for aspirating the solvent vapours, with the result that the feed of grains of powder and of finishing agents is necessarily discontinuous and the glazing or graphitizing processes are consequently discontinuous, on the subject of safety, the grains of powder are stirred in a confined atmosphere during the rotation of the drum or, if appropriate, the coating kettle, with the result that in the event of a spark inside the drum, the risks of detonation of the powder remain high, and the fact that the processes are discontinuous leads to an increase in the charge of powder for each operation and, furthermore, the charges treated can differ from one another, this heterogeneity resulting from the discontinuity of the process.

The precise object of the present invention is to propose a new apparatus which permits surface treatments of granular propellant powders by solid agents, which treatments are both continuous and do not present any risk of detonation of the propellant powder.

The object of the invention is achieved by means of a new apparatus which comprises, in particular, a vat and a shaft which is caused to rotate by a motor unit, and which is characterised, on the one hand, in that the bottom of the vat forms at least one chute comprising a portion of a surface of revolution, and, on the other hand, in that it comprises a stirring system possessing at least one stirrer, each stirrer consisting of a shaft which is essentially parallel to the axis of the corresponding chute and carries rigid blades, and at least one in four of the said blades being extended by a tongue which rubs against this chute.

More particularly, the bottom of the vat forms only a single essentially semi-cylindrical chute and the stirring system possesses only one stirrer, but other different embodiments can be used. According to a first variant, the bottom of the vat is plane and is joined to the side walls of this vat by means of two portions of a cylinder, the stirring system possessing two stirrers, the shafts of which are spaced apart at a distance which is slightly greater than the length of the blades, the latter being consequently staggered. According to a second variant, the bottom of the vat comprises three cosecant chutes and the stirring system possesses three stirrers.

The rigid blades are preferably essentially perpendicular to the support shaft and therefore move parallel to a plane perpendicular to the shaft when the apparatus is in operation, but, according to another different embodiment, the rigid blades are inclined and move along a cone centred on the axis of the shaft when the apparatus is in operation.

According to a first method of construction, the blades are distributed along the axle in several groups, the blades of each group being joined to the shaft in the same plane, which is perpendicular to this shaft, and each group preferably comprises four blades arranged radially relative to the shaft.

According to a second method of construction, the blades are distributed in a helix along the shaft.

Preferably, on the one hand, one blade in two is equipped with a tongue, especially when the bottom of the vat only possesses a single chute, this arrangement making it possible to limit the confinement of the powder between the bottom of the trough and the blades, and, on the other hand, the material constituting the tongues is a conductive plastic; however, the tongues can be formed in various ways and, in particular, they can consist of a brush of fibres such as metallic fibres.

The tongues are preferably wider than the blades and, when the apparatus is used for carrying out a glazing operation, in particular with a pulverulent solid suspended in a liquid, the width of the tongues is such that at least 80% of the inner surface of the bottom of the vat is swept by the tongues, in order to avoid the formation of lumps resulting from the agglomeration of grains of powder which arises from the suspension of solids.

According to a particular characteristic, each chute forming the bottom of the vat is inclined and the chutes are preferably portions of a cylinder, the inclination of which is provided by inclining the base of the apparatus, but, according to another different embodiment, the chutes are portions of cones, having a shallow slope, the surface envelope of the end of the blades also being a cone essentially corresponding to the cone portions of the chutes.

The apparatus according to the invention makes it possible to achieve the object of the invention by means of a process which consists in setting the stirring system in rotation, in introducing the grains of propellant powder and the finishing agents, simultaneously and continuously, into one of the ends of the said chute, and in collecting continuously, at the other end of the said chute, the grains of propellant powder, into the surface of which the said finishing agents are incorporated, the rates of introduction of the grains of powder and the finishing agents, as well as the possible inclination of the said chute, being such that the maximum height of the propellant powder in the said chute is, on the one hand, less than the critical height of the powder, that is to say less than the height above which the said propellant powder can, in the event of fire, detonate instead of deflagrating, and, on the other hand, permits the incorporation of the said finishing agents into the grains of powder.

By means of the apparatus according to the invention, a process for the surface treatment of granular powders is now available which is continuous and which does not present any risk of detonation because, at all points in the vat, the height of the propellant powder is less than its critical height.

The invention is explained by the detailed description of the apparatus, which refers to the drawings in which.

Figure 1:
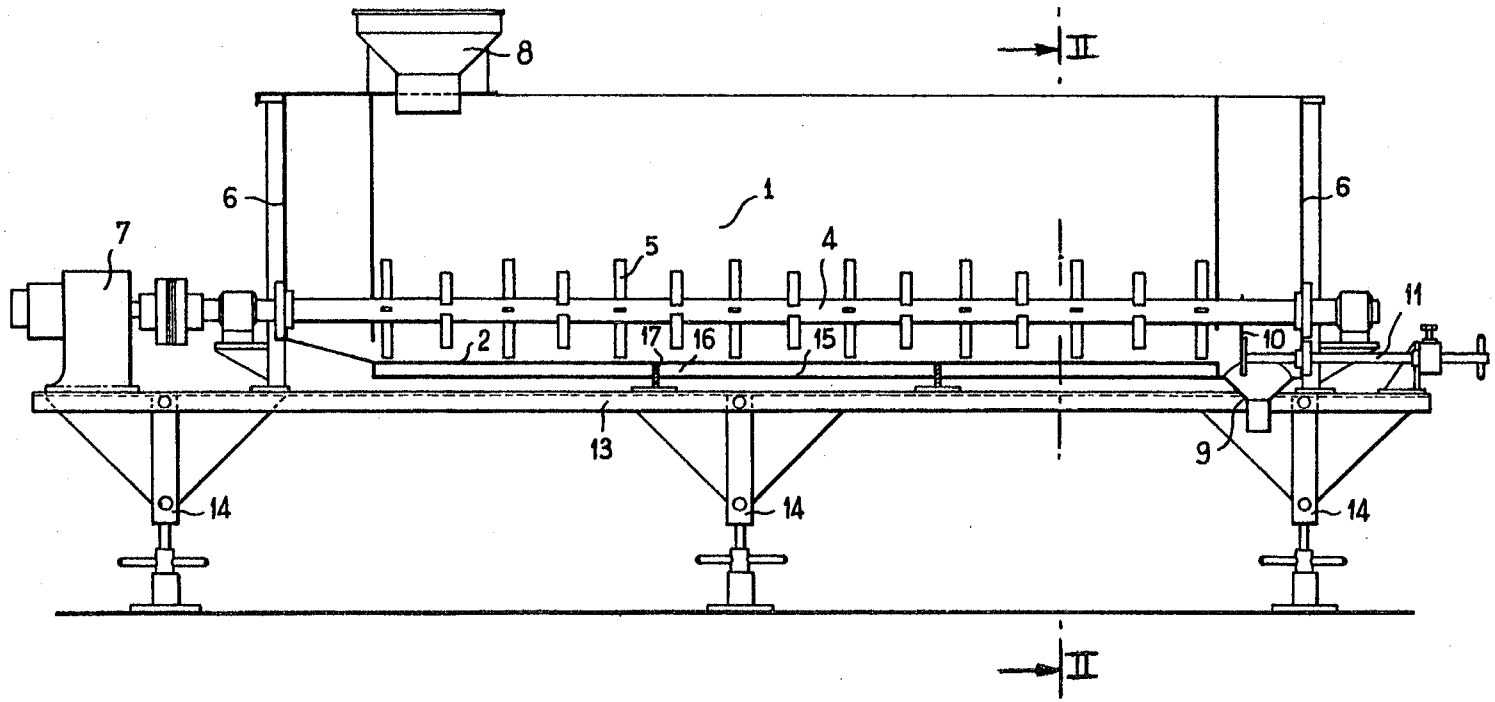
FIG. 1 is an overall view of the apparatus in longitudinal section.
Figure 2:
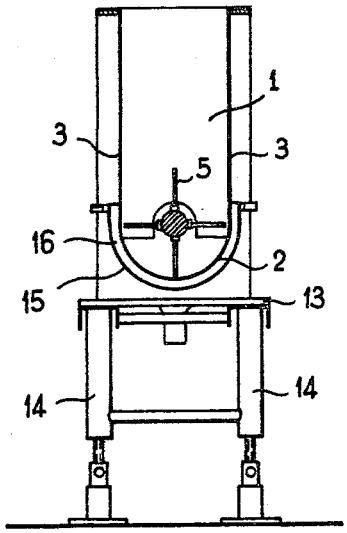
FIG. 2 is an overall view in transverse section along II—II of the apparatus shown in FIG. 1.

With more particular reference to FIGS. 1 and 2, these figures show the vat 1, the bottom of which is a semi-cylindrical chute 2 surmounted by parallelepipedal vertical walls 3, of which the transverse walls 6 allow the shaft 4 to pass through, which shaft is coaxial with the chute 2 and on which are fixed rigid blades 5. The axle 4 is driven by a pneumatic motor 7. The vat 1 is fed by means of feed hoppers 8 provided above one of the ends of the vat 1. Discharge takes place at the other end of the vat 1 by means of a discharge funnel 9.

In a particular embodiment of the invention, an adjustable sealing pad 10, which is joined to a guide-screw 11, is provided above the funnel 9 in order to make it possible for the flow-rate of the discharge funnel to be varied.

Figure 4:
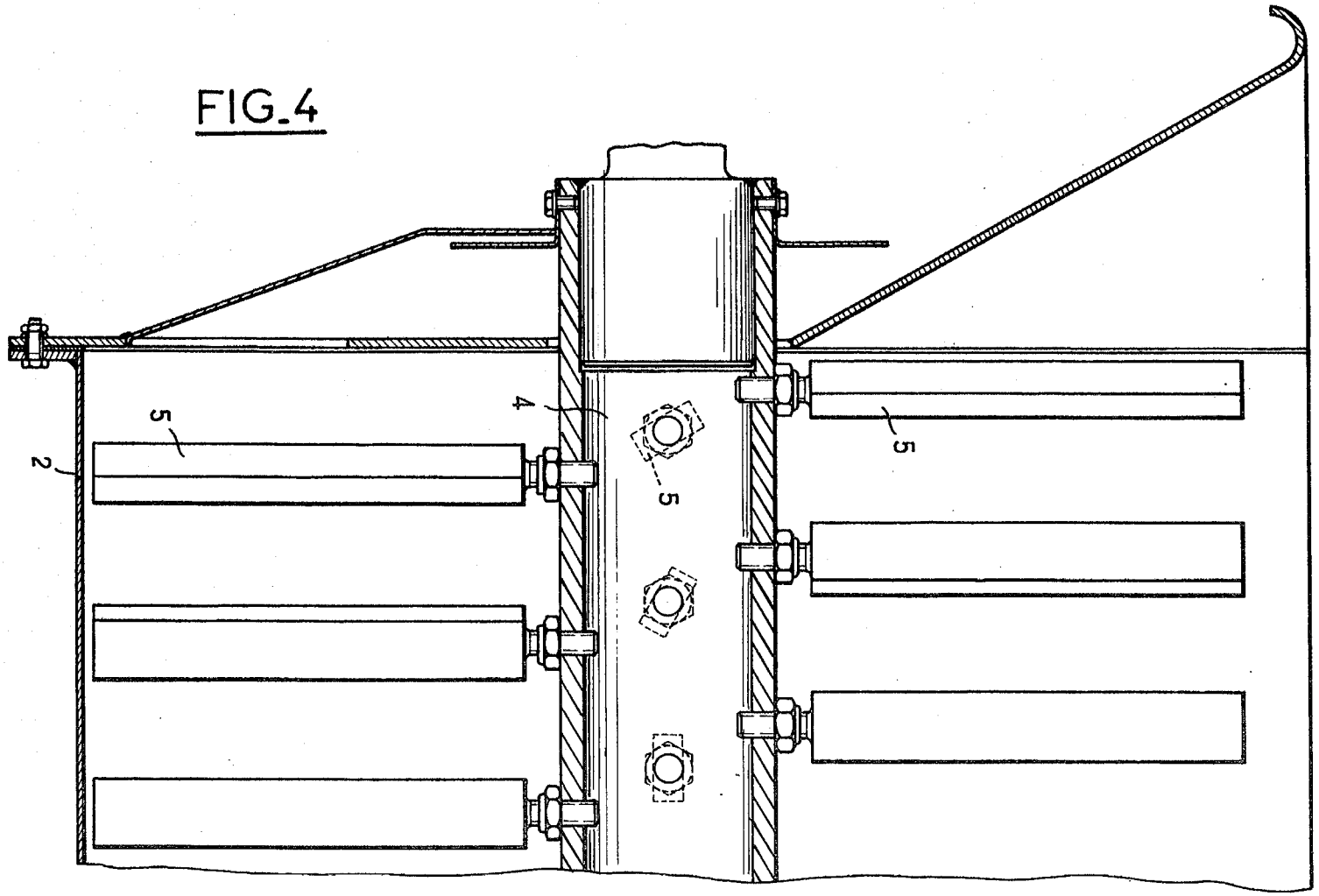
FIG. 4 is a partial detailed view in longitudinal section of a variant of the apparatus shown in FIG. 1.

In FIG. 1, it is seen that the rigid blades 5 are arranged in groups of four in the same plane, which is perpendicular to the shaft 4, each set of four blades being staggered by 45° relative to the two sets which surround it. This is not an obligatory arrangement but only a preferable arrangement. According to the invention, it is important that the shaft of the stirrer of the vat should carry a large number of blades, but the latter can have various arrangements on the shaft. For example, they can be arranged along a helix enveloping the shaft, as in FIG. 4 which shows the chute 2, the shaft 4 and the blades 5 which are arranged in a helix along the said shaft 4. The blades preferably have a parallelepipedal shape. As can be seen in the various figures, the blades have a length which is slightly less than the radius of the chute and do not therefore rub against the latter.

However, in order to ensure that the grains of propellant powder are mixed as well as possible with the finishing agents which it is desired to incorporate into the surface of the grains, it is necessary for certain of the blades to be equipped, at their end which is opposite that by which they are fixed to the shaft, with rigid or non-rigid tongues which sweep the bottom of the chute. This embodiment can be seen in particular in FIG. 3 which shows the chute 2, the shaft 4, the rigid blades 5 and the tongues 12. The inventors have found that it is necessary for at least one blade in four to be equipped with such a tongue. The more the proportion of blades equipped with tongues is increased, the better is the mixing of the grains of propellant powder. However, in order to avoid risks of confining the powder to the bottom of the chute, it is not desirable for all the blades to be equipped with tongues.

The inventors have been able to establish that, during the manufacture described subsequently by way of example, the best results are obtained when two blades in four are equipped with tongues. Furthermore, in order to avoid the formation of lumps of grains of powder by agglomeration of the grains which arises from the suspension of the solid agents, it is recommended that the width of the said tongues should be greater than that of the blades so that at least 80% of the inner surface of the chute is swept by the said tongues.

According to a first preferred embodiment of the invention, the vat 1 can be inclined so as to make it possible for the rate of flow of the grains of propellant powder into the vat can be varied simply by the action of gravity. In order to do this, the vat 1 rests on a base 13 which is fastened to the ground by means of feet 14 of adjustable height.

According to a second preferred embodiment of the invention, the vat 1 is thermostatically controlled. For this purpose, the chute 2 is surrounded by a concentric wall 15 which delimits a double envelope 16 between the said chute and the said wall, inside which envelope a fluid such as, for example, water is caused to circulate at a fixed temperature. It is also possible to partition the double envelope 16 into several successive leaktight compartments, in the direction of the length of the vat 1, by means of partitions 17 perpendicular to the axis of the chute 2, in which compartments fluids are caused to circulate at different temperatures so as to produce a gradation in the temperature of the chute in the direction of its length.

In order to ensure the maximum safety of the apparatus, it is imperative for the materials of the various elements which can come into contact with the grains of propellant powders to be conductors of electricity in order to facilitate the earthing of all parts of the vat and, in particular, of the chute and the stirrer.

Stainless steels will advantageously be used for the chute, the vertical walls, the shaft and the blades, and brasses or bronzes will advantageously be used for the tongues if it is desired to use rigid tongues. If flexible tongues are used, conductive rubbers will advantageously be used for the latter. Still for the purpose of safety, the motor driving the axle of the stirrer will advantageously be a pneumatic motor.

A detailed description of the process according to the invention is now given. The stirrer is set in rotation by starting the drive motor. The inventors have been able to observe that the speed of rotation of the stirrer shaft should preferably be between 25 and 200 revolutions/-minute, and in particular between 90 and 150 revolutions/minute. The grains of propellant powder and the finishing agents are introduced simultaneously and continuously through the feed hoppers, and the treated grains of powder are collected through the discharge funnel located at the other end of the vat. The said finishing agents can be introduced into the chute in the form of solids or in the form of a suspension or a solution in solvent baths. It is of value to have a vat which can be inclined, in order to make it possible to easily modify the residence time of the powder in the vat by setting the inclination given to the vat. In certain cases, it can be of value for the level of the mouth of the discharge funnel to be higher than the level of the bottom of the chute at the feed end; in other cases, the converse may be true. In any case, the feed rates of the powder and of the solid agents are such that the maximum height of the powder in the chute is less than the critical height of the powder, this critical height being different for each type of powder and being known to those skilled in the art. The inventors have found that, for the customary powders based on nitrocellulose, residence times, in the vat, of the order of half an hour for glazing operations or fifteen minutes for graphitizing operations are generally sufficient.

In the case of glazing operations, the inventors have also observed that it is advantageous to have a chute surrounded by a double envelope which is partitioned into independent compartments in the direction of the length, so that the chute can be slightly heated at the feed end and so that it is cooled at the discharge end; a better penetration of the moderators into the surface of the grains of powder is thus obtained. In certain glazing operations, it can also be of value to work with grains of propellant powder which still contain a small amount of solvents, the grains thus being more permeable to the moderators; in this case, it can be advantageous to place a cover over the vat in order to avoid significant evaporation of the residual solvents. However, the said cover must be simply placed over the vat and not firmly fixed to the latter, so that the said cover can be easily thrown off in the event of the grains of powder catching fire; if this is not done, the combustion of the powder would take place in a confined atmosphere and the risks of detonation of the powder would again appear.

The following example, which is given without implying a limitation, describes an apparatus according to the invention and its application to the treatment of grains of propellant powder.

EXAMPLE

Figure 3:
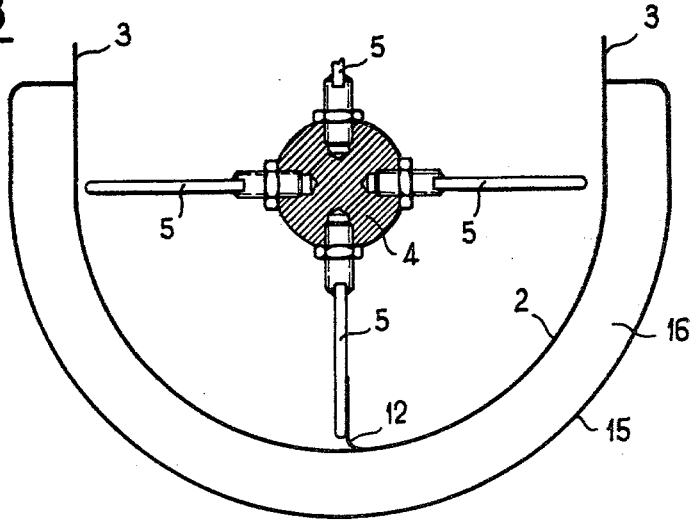
FIG. 3 is a partial detailed view in transverse section of the apparatus shown in FIG. 2.

The apparatus used in this example was analogous to the apparatus shown in FIGS. 1, 2 and 3.

The chute 2, the parallelepipedal vertical walls 3, the shaft 4, and the blades 5 arranged as shown in FIG. 1 were made of stainless steel.

The tongues 12 were made of conductive rubber. The whole vat was electrically earthed. The chute was 3 meters long, its internal radius was 12.5 centimeters and the stirrer shaft was concentric with the axis of the chute. The height of the walls above the shaft was 50 centimeters. The blades were 11 centimeters long and 10 centimeters wide. In each set of four blades, one blade in two terminated in a 12 centimeter wide tongue made of conductive rubber. There were twenty sets of four blades distributed along the whole length of the stirrer shaft. The chute was surrounded by a 3 centimeters thick double envelope partitioned into three separate compartments in the direction of the length. The stirrer was driven by a pneumatic motor.

A spherical powder based on nitrocellulose, and containing 2% by weight of water and residual solvents, was treated in this vat.

Firstly, glazing was carried out at ordinary temperature using a salt bath essentially comprising:

isopropyl alcohol: 8 parts by weight
potassium nitrate: 4 parts by weight
dibutyl phthalate: 1 part by weight.

The glazing was carried out in a closed vat, the speed of rotation of the stirrer was 150 revolutions per minute and the bottom of the vat was horizontal. The feed rate of the grains of powder was 30 kg/hour and the feed rate of the glazing bath was 500 g of glazing solution per 15 kg of powder. Under these conditions, the residence time of the powder in the chute was 30 minutes.

The grains of powder which had been glazed in this way were then graphitized. The graphitizing was carried out in an open vat, the speed of rotation of the stirrer was 150 revolutions/minute and the vat remained horizontal. The feed rate of the grains of powder was also 30 kg/hour and the feed rate of the graphite in the pulverulent state was 27 g of graphite per 15 kg of powder. Under these conditions, the residence time of the powder in the chute was 15 minutes.

The maximum height of the powder during the glazing and graphitizing operations was between 7 and 8 cm under these conditions.

By way of comparison, the same grains of powder were glazed with the same glazing solution and graphitized by the conventional technique using a coating kettle. The physico-chemical and ballistic characteristics of the grains of powder treated by the two processes are given below.

| | Grains of powder treated according to the invention | Grains of powder treated in a coating kettle |
|---|---|---|
| Physico-chemical properties | | |
| Apparent density | 962 g/dm$^3$ | 954 g/dm$^3$ |
| Moisture and volatile substances | 0.76% by weight | 0.73% by weight |
| Residual solvents | 0.47% by weight | 0.41% by weight |
| Ballistic properties | | |
| (firings from a 7.62 mm calibre gun powder charge: 2.86 g weight of the bullet: 9.60 g) | | |
| Speed of the bullet at 25 m from the gun | 821 m/second | 824 m/second |
| Duration of the shot | 1.506 seconds | 1.494 seconds |
| Maximum pressure | 3,103 bars | 3,107 bars |

It is seen that the apparatus and the process according to the invention lead to results which are analogous to those obtained by the conventional technique using a coating kettle, but that they offer, in addition, the possibility of a continuous process and that they bring an increase in safety by eliminating the risk of detonation of the powder, this risk being very high in the technique using a coating kettle or a drum.

The main applications of the apparatus according to the invention relate to the operations of glazing and graphitizing the powders, but this apparatus can be used in any operation for mixing granular elements, with the incorporation of finishing agents or without any incorporation of an agent, in order, for example, to dry these granular elements.

We claim:

1. Apparatus for the continuous surface treatment of granular propellant powders comprising a vat and a stirring system, the bottom of the said vat forming at least one chute comprising a portion of a surface of revolution, the said stirring system possessing at least one stirrer consisting of a shaft which is essentially parallel to the axis of the said corresponding chute and carries rigid blades, some of the said blades being extended by a tongue which rubs against the said chute, the number of blades which are extended by a tongue being less than the total number of blades;

(a) the said blades have a length which is slightly less than the radius of the said chute, (b) at least one blade in four is equipped with a tongue, and (c) the materials of the various elements which can come into contact with the grains of propellant powders are conductors of electricity, (d) the width of the said tongues being such that at least 80% of the inner surface of the bottom of the vat is swept by the tongues.

2. Apparatus according to claim 1, wherein the bottom of the vat forms only a single essentially semi-cylindrical chute, the stirring system possessing only one stirrer.

3. Apparatus according to either one of claim 1 or 2, wherein one blade in two is equipped with a tongue.

4. The apparatus according to claim 1 wherein said blades are perpendicular to said shaft.

5. The apparatus according to claim 1 which is provided with means for inclining the bottom of said vat.

6. A process for continuous surface treatments of granular propellant powders which consists of introducing simultaneously and continuously grains of propellant powder and finishing agents at one of the ends of the chute in an apparatus comprising a vat and a stirring system, the bottom of the said vat forming at least said one chute comprising a portion of a surface of revolution, the said stirring system possessing at least one stirrer consisting of a shaft which is essentially parallel to the axis of the said corresponding chute and carries a plurality of rigid blades, wherein the blades have a length which is slightly less than the radius of the chute, at least one blade in four is extended by a tongue which rubs against the chute, the materials of the various elements which come into contact with the grains of propellant powders are conductors of electricity; the width of said tongues being such that at least 80% of the inner surface of the bottom of the vat is swept by the tongues, setting the stirring system in rotation at a speed of between 25 and 200 revolutions per minute, collecting the grains of powder at the other end, the rates of introduction of the grans of powder and of the finishing agents being such that the maximum height of the propellant powder in the chute is less than the critical height above which said powder could detonate.

7. The process according to claim 6 wherein the residence time of said propellant powder in said at least one chute is varied by inclining said chute which forms the bottom of said vat.

* * * * *